US006920810B1

(12) United States Patent
Thompson et al.

(10) Patent No.: US 6,920,810 B1
(45) Date of Patent: Jul. 26, 2005

(54) METHOD AND APPARATUS FOR ATTACHING AND DETACHING AN ATTACHABLE DEVICE

(75) Inventors: Christopher D. Thompson, Milwaukee, WI (US); Charles H. Heiligenthal, Kenosha, WI (US); Michael L. Foster, Kenosha, WI (US)

(73) Assignee: Snap-on Incorporated, Pleasant Prairie, WI (US)

( * ) Notice: Subject to any disclaimer, the term of this patent is extended or adjusted under 35 U.S.C. 154(b) by 0 days.

(21) Appl. No.: 10/691,226

(22) Filed: Oct. 21, 2003

Related U.S. Application Data

(60) Provisional application No. 60/422,819, filed on Oct. 31, 2002.

(51) Int. Cl.[7] ..... B25B 23/16

(52) U.S. Cl. ..... 81/177.85; 81/177.2; 81/438; 279/38

(58) Field of Search ..... 81/177.1, 177.2, 81/177.85, 438; 279/38

(56) References Cited

U.S. PATENT DOCUMENTS

| | | | |
|---|---|---|---|
| 4,176,699 | A | 12/1979 | Leitner |
| 4,537,100 | A | 8/1985 | Palm |
| 4,692,073 | A | 9/1987 | Martindell |
| 4,833,951 | A | 5/1989 | Karcher et al. |
| 4,859,110 | A | 8/1989 | Dommel |
| 5,477,758 | A | 12/1995 | Cunningham |
| 5,573,255 | A | 11/1996 | Salpaka |
| 5,674,024 | A | 10/1997 | Daumal Castellon |
| 5,685,208 | A | 11/1997 | Tidwell |
| 5,954,347 | A | 9/1999 | Buck et al. |
| 6,085,618 | A | 7/2000 | Macor |
| 6,092,814 | A | 7/2000 | Kageler |
| 6,199,872 | B1 | 3/2001 | Hasan |
| 6,270,085 | B1 | 8/2001 | Chen et al. |
| 6,325,393 | B1 | 12/2001 | Chen et al. |
| 6,378,400 | B1 | 4/2002 | Bogli |
| 6,457,916 | B2 | 10/2002 | Wienhold |
| 6,474,656 | B1 | 11/2002 | Thomas |
| 2001/0043841 | A1 | 11/2001 | Wienhold |

*Primary Examiner*—James G. Smith
(74) *Attorney, Agent, or Firm*—Seyfarth Shaw LLP

(57) ABSTRACT

A method and apparatus for coupling an attachable tool to a handle comprising a coupler device fixedly attached to the handle and having a locking structure moveable between locking and release conditions and being carried by a coupler body having an inner wall defining a cavity that is accessible via a cavity dimensioned and shaped to receive the attachable tool and having a first locking member for cooperative abutting engagement with the attachable tool to temporarily move the locking structure to its release condition when the attachment shaft is inserted into the cavity and a second locking member for cooperative engagement with the locking structure when the attachment shaft is inserted substantially into the cavity and the locking structure is moved to the locking position to inhibit removal of the attachment shaft from the cavity.

18 Claims, 6 Drawing Sheets

METHOD AND APPARATUS FOR ATTACHING AND DETACHING AN ATTACHABLE DEVICE

CROSS REFERENCE TO RELATED APPLICATION

This application claims the benefit of the filing date of U.S. Provisional Application No. 60/422,819, filed Oct. 31, 2002.

BACKGROUND

The present application relates generally to a method and apparatus of attaching hand operated tools to a handle. More specifically, the present application relates to an improved device with an interchangeable attachable member, a coupler device and a handle.

It is known in the art that tool handles with detachable tool heads are preferred over conventional handled tools in order to minimize the amount of bulky tools which may be required for any particular job. As such, the worker is more efficient and productive due to the greater number of functional tool heads available without the unnecessary burden of transporting individual handled tools. However, in order to be effective, the tool heads must be easily and quickly attachable, as well as ergonomically efficient. Furthermore, the attachment mechanism must provide a secure and reliable connection between the handle and the tool head in order to ensure usability.

Existing connecting means provided between tool heads and tool handles generally include a cavity located on the handle for receiving an end of the tool head. This is generally accomplished with a slip connection providing frictional engagement or a spring-loaded detent mechanism. However, these types of connections do not lock the tool head in place and may result in inadvertent detachment of the tool head from the tool handle.

Other existing connecting means includes a cavity with a spring-loaded deactivation button or a chuck with a rotateable collar for opening and closing gripping jaws for gripping a tool shaft. However, such devices require manual release of the locking mechanism via the button or reverse rotation of the rotateable collar to attach and/or detach a tool head. As such, tool head insertion and ejection may be cumbersome and time consuming.

SUMMARY

There is illustrated herein an improved device adapted for efficient and reliable interchangeability of various attachments.

The unique and improved device of the present application incorporates an interchangeable attachable member, a coupler device and an ergonomically efficient handle oriented relative to the attachable member for maximum efficiency and hand gripping. The attachable member can comprise any type of hand-held tool head, such as a ratchet head, a screwdriver, an open ended wrench head and the like, or any other type of device. Numerous types of tool heads and devices may be compatible with the coupling device of the present application.

An attachment shaft is provided on one end of the attachable member for coupling engagement with the coupler device. A tool head may be provided on the other end of the attachable member. Furthermore, the attachment shaft may contain a keyway for engagement with a key contained within the coupler device for rotational alignment of the attachable member relative to the handle.

The coupling technique comprises a unique and improved method and apparatus to facilitate attachment and detachment of various attachable members. The coupler device is biased to a locking position, an internal locking mechanism being shiftable to a release position by cam actuation of a coupler sleeve circumferentially disposed around the periphery of the coupler device's body, caused by the axial force of inserting the attachable member into the coupler device. When the attachable member reaches the locking location, the coupler device is automatically returned to its biased locking position, thus securely engaging and orienting the attachable member relative to the handle.

Detachment of the attachable member occurs by manual cam actuation of the coupler sleeve, thus disengaging the locking mechanism from the attachable member, whereupon the attachable member is gently ejected from the coupler device by a compression spring. The coupler device is then ready to receive a different attachable member, if one is desired.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages, should be readily understood and appreciated.

DETAILED DESCRIPTION

Figure 1:
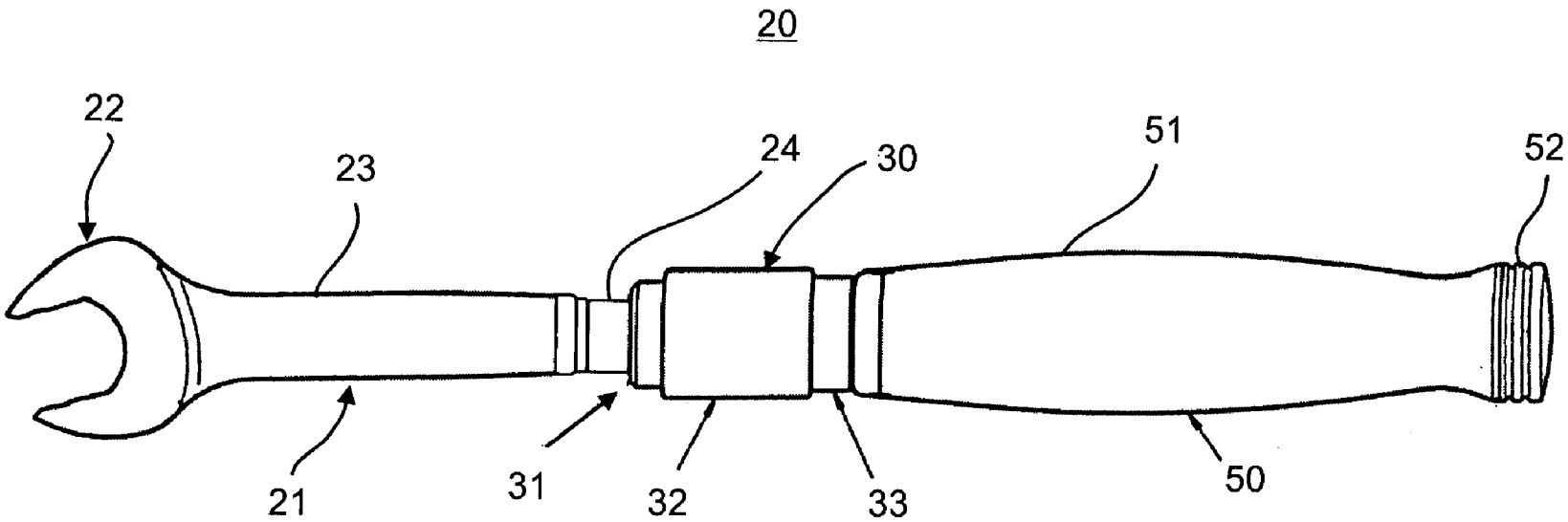
FIG. 1 is a side view of an embodiment of a tool device of the present application with an attachable member partially inserted in a handle.
Figure 2:
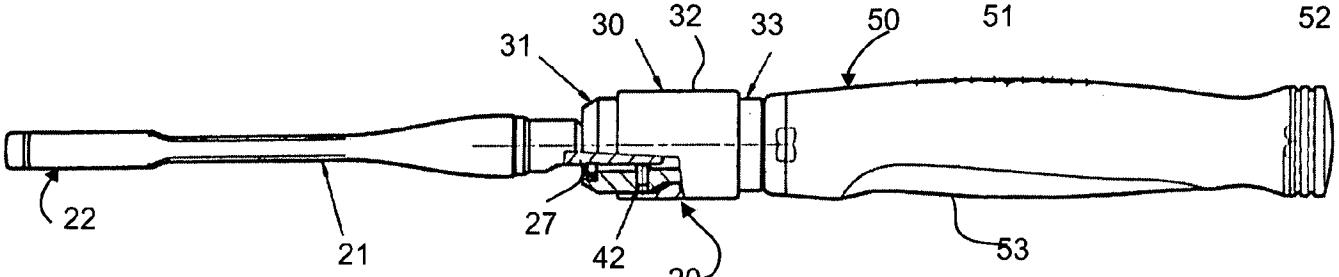
FIG. 2 is a bottom view of the tool device of FIG. 1 with a portion broken away.
Figure 3:
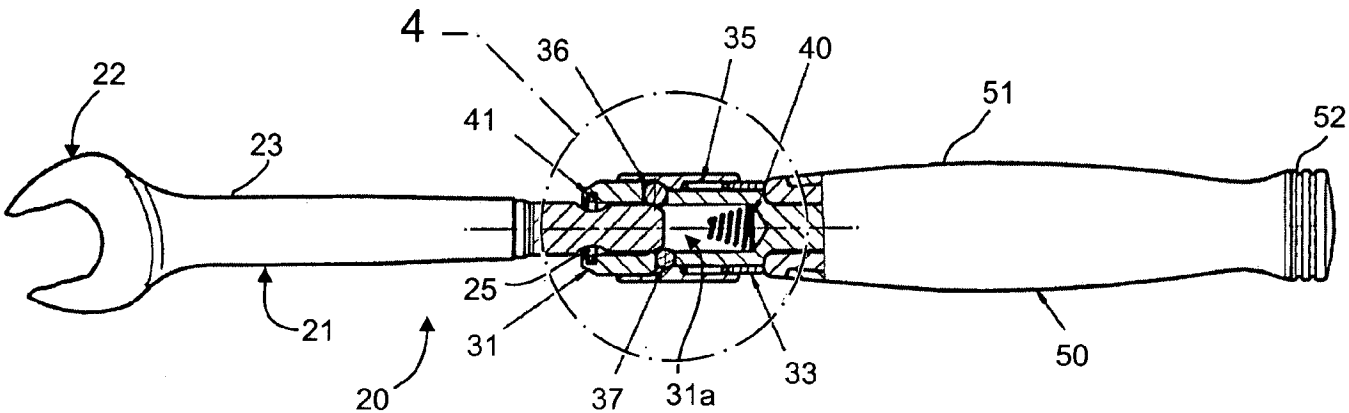
FIG. 3 is a view similar to FIG. 1 in partial section shown at the beginning of the attachment process.

Referring to FIGS. 1–3, there is illustrated an improved tool device 20 adapted for interchangeability of various attachable members 21. The tool device comprises an attachable member 21, a coupler device 30 and a handle 50. The coupler device 30 is fixedly attached to one end of the handle 50 and provides a quick and effective means for detachably connecting the attachable member 21 to the handle 50, while maintaining the attachable member's 21 rigidity and stability relative to the handle 50. It will be appreciated that the coupler device 30 is not limited to use with the handle 50 and attachable member 21 disclosed herein, but rather can be utilized wherever an effective and efficient coupling means is desired.

The attachable member 21 is an independent and interchangeable component and may have any hand-held working head 22 such as a tool head or other device incorporated on one end thereof. While a head 22 is illustrated in the figures as an open-end wrench head, it will be appreciated that other heads 22 can be provided, such as a ratcheting head, a screwdriver, an extension, a box-end wrench, and the like. Furthermore, while the attachable member 21 is illustrated in the figures as a tool headed device, it will be appreciated that the attachable member 21 can comprise any type of device where coupling attachment is desired. Since the attachable member 21 is detachably connected to the handle 50, the attachable member 21 can be easily and quickly detached from the handle 50 via the coupler device 30 and replaced with a different attachable member 21, depending upon the mechanical objective to be accomplished.

Figure 4:
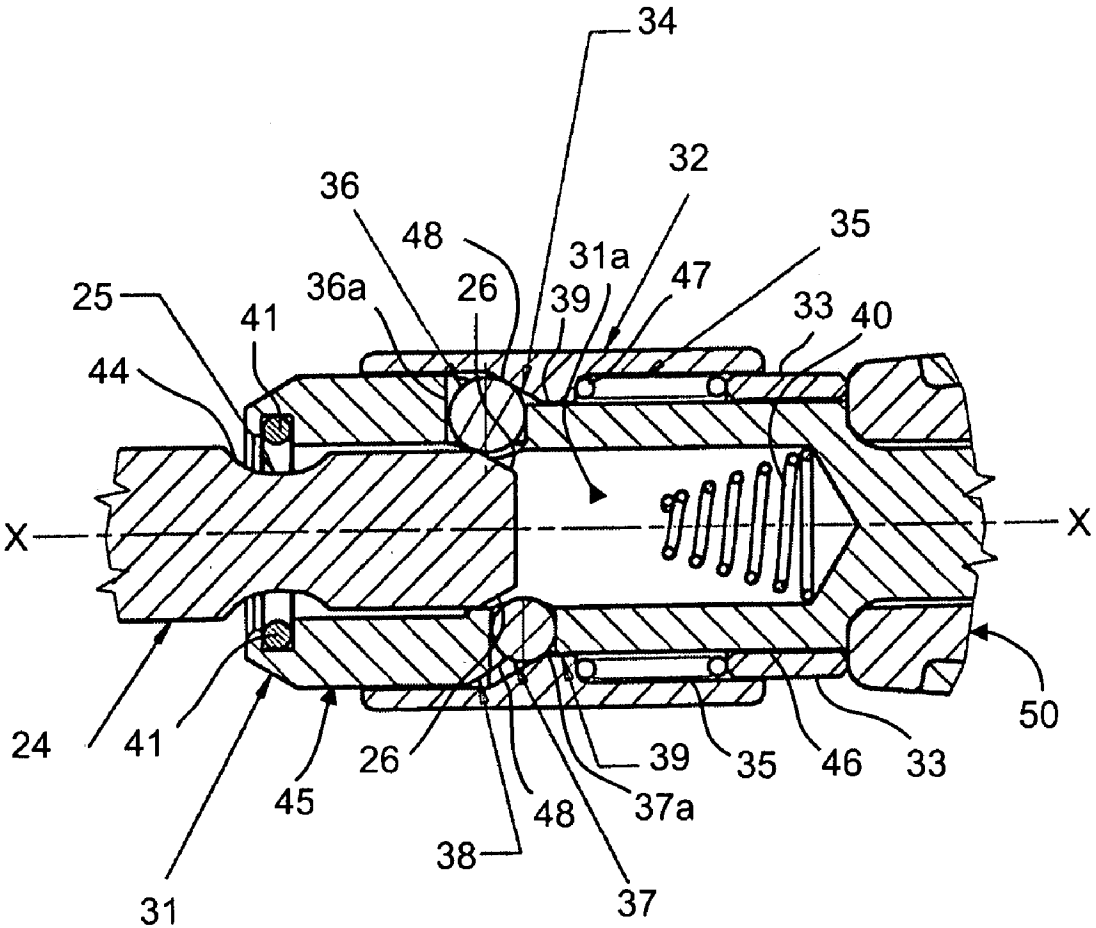
FIG. 4. is an enlarged, fragmentary, cross-sectional view of the coupler device of the tool device of FIG. 3.

Referring also to FIG. 4, the other end of the attachable member 21 has an attachment shaft 24 for coupling attachment with the coupler device 30. The attachment shaft 24 is dimensioned and configured to be internally received by the coupler device 30. In an embodiment, the attachment shaft 24 has a circular cross-section with at least one insertion guide 27 to rotationally orient the attachment shaft 24 relative to the coupling device 30 and prevent relative rotation thereof, once coupled, thus ensuring a consistent orientation of the attachable member 21 relative to the handle 50. The insertion guide 27 may comprise at least one keyway in the form of an axially extending groove or flattened portion in the outer surface of the attachment shaft 24 for cooperatively receiving a key or guide 42 located in the coupler device 30, as discussed further below.

The attachment shaft 24 further comprises a lock engagement portion 25 disposed adjacent to its distal end for engaging the locking apparatus of the coupling device 30, as discussed further below. The lock engagement portion 25 may comprise a circumferential channel or groove in the outer surface of the attachment shaft 24. In an embodiment, the channel has an arcuate cross-section for receiving and engaging the locking apparatus, as more fully described below.

In an embodiment, the distal end of the attachment shaft 24 has an attachment shaft angle 26, for deactivation of the locking apparatus when the attachment shaft 24 is initially inserted into the coupler device 30. The attachment shaft angle 26 may be chamfered or radiused edges of the attachment shaft 24.

The attachment shaft 24 may also have a first shaft section disposed toward the head 22 and forwardly of the lock engagement portion 25 and a second shaft section disposed rearwardly of the lock engagement portion 25, integrally connected thereto. The first shaft section may have a greater diameter compared to the second shaft section.

Referring to FIG. 2, the handle 50 is constructed of such a shape and dimension to be easily operated with a human hand. The handle 50 comprises a grip portion 51, a handle base 52 and a handle indentation 53. The handle base 52 is disposed on the distal end of the handle 50 and may be a detachable cap, such as of a screw-on type design, thus allowing access to a storage cavity portion contained within the handle 50, for storage of items such as fasteners and the like. Fixedly attached to the opposite end of the handle 50 is the coupler device 30. The coupler device 30 attachment to the handle 50 may occur by integral construction of the coupler device 30 and handle 50, or the like. The handle indentation 53 is ergonomically contoured and shaped to facilitate comfortable gripping by a human hand. As such, the handle indentation 53 may be axially aligned with the attachable member 21 allowing the greatest comfortable feel. It will be appreciated that the configuration of the handle 50 as described herein does not affect the functionality of the coupler device 30, and, as such, the handle 50 may by of other shapes or designs.

Figure 5:
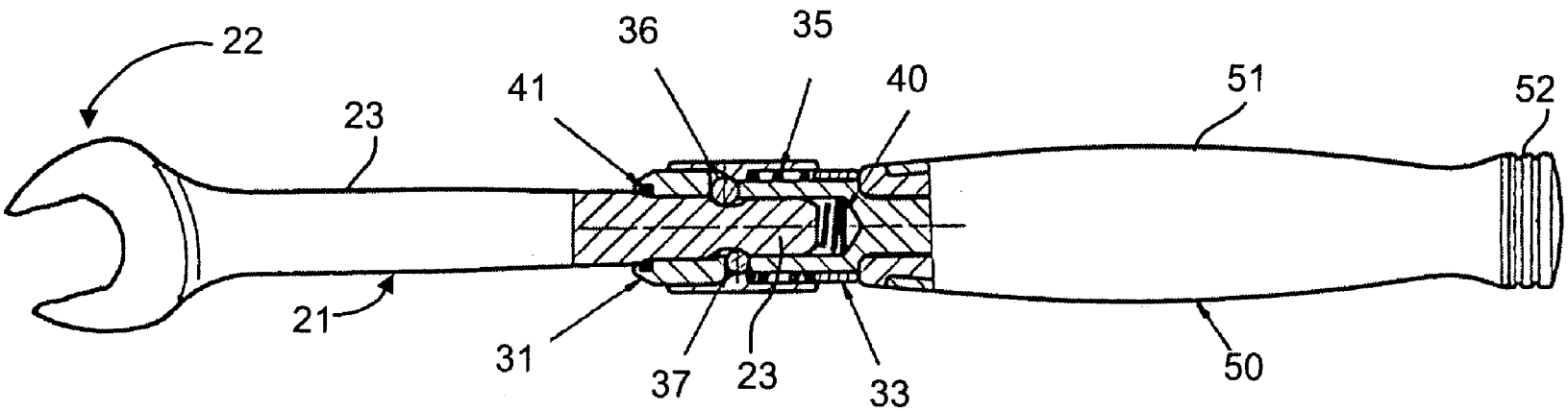
FIG. 5 is a view similar to FIG. 3 shown in a fully attached position.

Referring to FIGS. 3–5, the coupler device 30 comprises a coupler body 31 with a generally cylindrical coupler cavity 31*a* located therein and having a central longitudinally aligned axis X. One end of the coupler device 30 comprises a coupler aperture 44 having a dimension and shape to readily receive the attachment shaft 24 of the attachment member 21 for access to the coupler cavity 31*a*. It will be appreciated that the coupler device 30 can be used alone or in combination with other devices where a coupling means is desired.

The coupler body 31 has a first cylindrical exterior surface 45 and a second cylindrical exterior surface 46 integrally connected by a frustoconical shoulder portion 48. In an embodiment, the first cylindrical exterior surface 45 is disposed adjacent to the coupler aperture 44 end and the second cylindrical exterior surface 46 is disposed adjacent to the opposite end of the coupler body 31. The first cylindrical exterior surface 45 may have an outer diameter greater than the second cylindrical exterior surface 46.

A circumferential groove or channel may be provided on the internal surface of the coupler cavity 31*a* and adjacent to the coupler aperture 44 for a seal 41 so that when the attachment shaft 24 is inserted therein, the seal 41 provides a seal-like engagement with the exterior surface of the attachment shaft 24, thus preventing contaminants from entering the coupler cavity 31*a* and providing a more secure and snug fit between the attachable member 21 and coupler device 30 during utilization.

In an embodiment, the cavity 31*a* terminates at a terminal wall at an end opposite the coupler aperture 44. A compression spring 40 may be seated against the terminal wall. In an embodiment, the compression spring 40 is conically shaped and has its terminus disposed toward the coupler aperture 44 of the coupler device 30.

The coupler cavity 31*a* may have a first cavity section disposed toward the coupler aperture 44 and a second cavity section disposed toward the terminal wall, the first and second cavity sections being joined by an annular shoulder at a location approximately radially aligned with the forward end of the frustoconical shoulder portion 48. The first cavity section may have an inner diameter greater than the second cavity section.

In an embodiment, the coupler body 31 carries a locking structure selectively moveable between locking and release conditions and adapted for engagement with cooperative first and second locking members 36, 37 carried by the inner wall of the coupler cavity and respectively disposed in first and second radial bores 36*a*, 37*a* and rotationally spaced apart about 180 degrees relative to one another. In an embodiment, the first radial bore 36*a* has an axis disposed adjacent to the forward end of the frustoconical shoulder portion 48 and the second radial bore 37*a* has an axis disposed adjacent to the rearward end of the frustoconical shoulder portion 48. As such, the first and second radial bores 36*a*, 37*a* are axially offset relative to each other. In such a configuration, when the attachment shaft 24 is inserted into the coupler cavity 31*a*, the attachment shaft angle 26 encroaches the first locking member 36 prior to the second locking member 37.

Each first and second locking member 36, 37 may be first and second detent balls, respectively. In an embodiment, the first detent ball is larger than the second detent ball. The first and second radial bores 36*a*, 37*a* may provide inwardly turned inner edges at the cavity wall defining diameters slightly smaller than the respective detent balls to prevent the detent balls from falling into the interior of the coupler cavity 31*a*.

Referring also to FIG. 2, a guide 42, in the form of a key, may be disposed on an interior surface of the coupler cavity 31*a* for engagement with the insertion guide 27 of the attachment shaft 24 to axially guide the attachment shaft 24 into the coupler device 30 when the attachment shaft 24 is inserted therein. Once the attachment shaft 24 is coupled to the coupler device 30, the guide 42 prevents rotational movement of the attachable member 21 relative to the handle 50.

The locking structure may include a cylindrical coupler sleeve 32 disposed around coupler body 31 and longitudinally movable relative thereto. The coupler sleeve 32 is guided along the periphery of the coupler body 31 by a sleeve guide 33 disposed between the interior surface of the coupler sleeve 32 and the second exterior surface 46.

The coupler sleeve 32 comprises a sleeve ramp 34 disposed adjacent to the frustoconical shoulder portion 48 when the coupler sleeve is maintained in its biased position. The sleeve ramp 32 is inclined at an angle approximating that of the frustoconical shoulder portion 48 and inwardly terminating at a cylindrical base portion defining a sleeve ledge 39. The sleeve ledge 39 longitudinally terminates with a sleeve backstop 47 or annular shoulder which may be generally perpendicular to axis X. As such, the sleeve ramp 34 is abuttably engageable with the frustoconical shoulder portion 48 at a first terminus of slideable movement of the coupler sleeve 32 relative to the coupler body 31. In an embodiment, a sleeve compression spring 35 is disposed radially between the coupler sleeve 32 and second exterior surface 46 and longitudinally between the sleeve backstop 47 and sleeve guide 33. As such, the sleeve compression spring 35 biases the coupler sleeve 32 forwardly to its first terminus of slideable movement, thus predisposing the second locking member 37 and the locking structure in a locking condition. A second terminus of slideable movement of the coupler sleeve 32 is defined by substantial compression of the sleeve compression spring 35 thus disposing the locking structure in a release condition.

In an embodiment, when the coupler sleeve 32 is disposed in its first terminus position, the sleeve ramp 34 is engaged with the first locking member 36 for urging it to project radially inwardly from the radial bore 36*a*, while the sleeve ledge 39 engages the second locking member 37 to hold it in a locking condition projecting radially inwardly from the radial bore 37*a*.

Referring to FIGS. 1–5, a method of coupling allows quick and easy attachment and detachment of the attachable member 21 to the coupler device 30 by simply inserting the attachment shaft 24 of the attachable member 21 into the coupler device 30. During attachment, the attachment shaft 24 is axially inserted into the coupler device 30 and rotated relative to the coupler device 30 until the insertion guide 27 interacts and is aligned by the guide 42. Further axial force is applied to the attachable member 21 wherein the attachment shaft angle 26 engages the first locking member 36, camming it radially outwardly into camming engagement with sleeve ramp 34. Due to the inclined angular design of the sleeve ramp 34, the radial force caused by the first locking member 36 causes the coupler sleeve 32 to be cammed rearwardly in a longitudinal direction toward the sleeve guide 33, thus compressing the sleeve compression spring 35. The parts are dimensioned to permit sufficient radial outward movement of the locking member 36 to allow clearance of the rearward or second shaft section of the engagement shaft 24.

The cammed rearward movement of the coupler sleeve 32 causes the sleeve ramp 39 to disengage from the second locking member 37, whereupon, when the attachment shaft angle 26 engages the second locking member 37, it can cam the second locking member 37 radially outwardly and into camming engagement with the sleeve ramp 34, assisting its rearward movement and permitting clearance of the second shaft section of the engagement shaft 24. The second shaft section of the attachment shaft 24 causes the first and second locking members 36, 37 to maintain their respective radial dispositions, thus causing the sleeve ramp 34 to continually cause the coupler sleeve 32 to compress the sleeve compression spring 35. This action occurs until the lock engagement portion 25 is substantially aligned with the first and second locking members 36, 37 whereupon the first and second locking members 36, 37 may be driven radially inwardly, under the urging of the compression spring 35, which expands and forces the coupler sleeve 32 to return to its biased locked position at the first terminus of longitudinal movement, subsequently lockingly engaging the second locking member 37 in the lock engagement portion 25 by the sleeve ledge 39, as depicted in FIG. 5. When the attachable member 21 is fully inserted and lockably attached into the coupler device 30, the compression spring 40 is compressed. This method can thus be accomplished with minimal axial force applied to the attachable member 21, the insertion of which automatically releases the locking members 36, 37 to permit full insertion and automatic locking with no other outside forces introduced to the coupler device 30.

Detachment of the attachable member 21 from the coupler device 30 occurs by manually sliding the coupler sleeve 32 toward the sleeve guide 33, thus releasing the first and second locking members 36, 37 and permitting them to be cammed out of the lock engagement portion 25, as the compression spring 40 expands to eject the attachable member 21.

Figure 6:
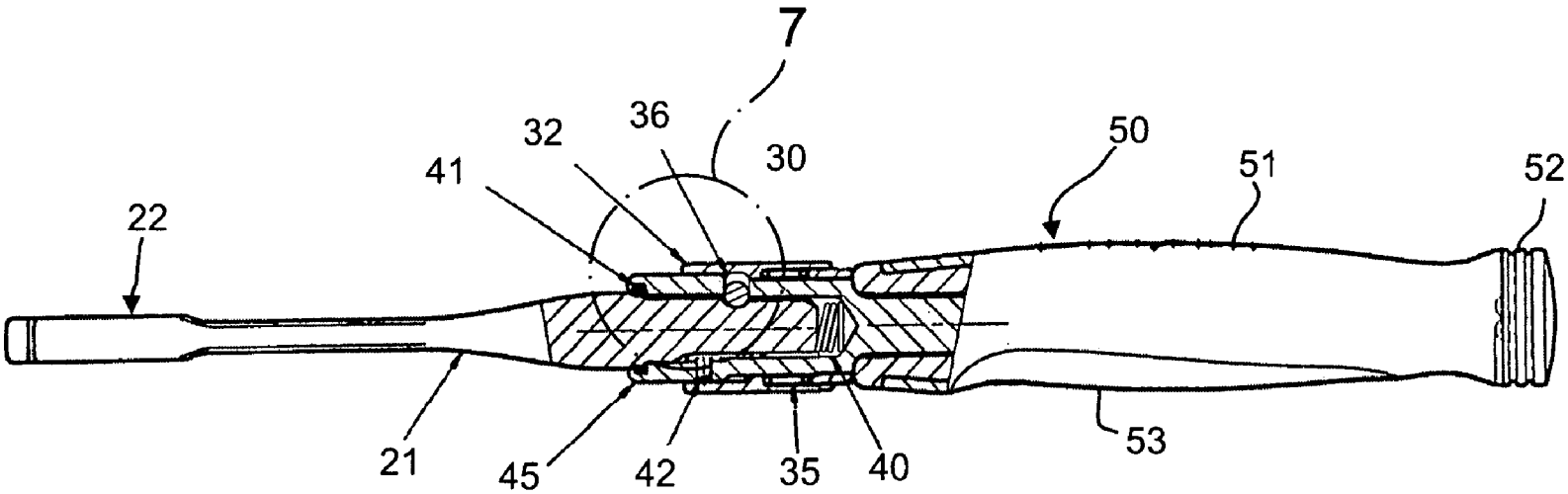
FIG. 6 is a view similar to FIG. 5 showing an alternate embodiment of the coupler device.
Figure 7:
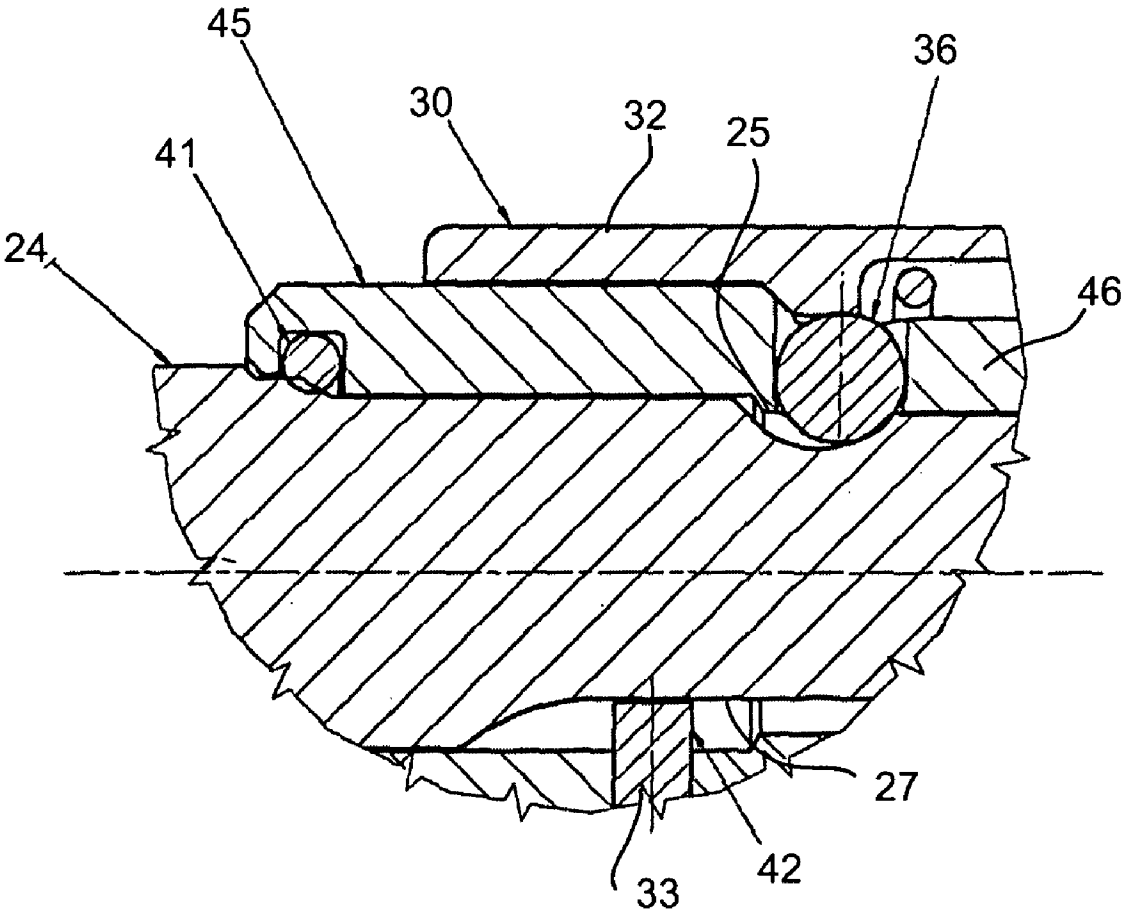
FIG. 7 is an enlarged, fragmentary, cross-sectional view of the coupler device of FIG. 6

Referring to FIGS. 6–7, a second embodiment is illustrated, wherein only a first locking member 36 is provided. In such an embodiment, the attachment shaft 24 may have a lock engagement portion 25 in the shape of a small indentation to engage the locking member 36 when the attachment shaft 24 is fully inserted into the coupler device 30. In order to operate this embodiment, the coupler sleeve 32 must be manually actuated in a longitudinal manner in order to disengage the locking member 36 and insert the attachment shaft 24.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

We claim:

1. A tool device comprising:

a detachable tool member having a tool head and an attachment shaft with a locking engagement portion;

a handle; and a coupler device fixedly attached to the handle and having a locking structure selectively moveable between locking and release conditions and being carried by a coupler body having an inner wall defining a cavity that is accessible via a cavity aperture and terminating with a terminal wall opposite the cavity aperture, the cavity being dimensioned and shaped to receive the attachment shaft, a first locking member carried by the inner wall for cooperative engagement with the attachment shaft to temporarily move the locking structure to its release condition when the attachment shaft is inserted into the cavity, and a second locking member carried by the inner wall for cooperative engagement with the locking engagement portion and the locking structure when the attachment shaft is inserted substantially into the cavity to accommodate movement of the locking structure to its locking condition to inhibit removal of the shaft from the cavity.

2. The device as claimed in claim 1 further comprising a bias structure resiliently urging the locking structure to its locking position.

3. The device as claimed in claim 1 wherein the coupler body includes first and second radial bores disposed in the internal wall, the first and second radial bores being rotationally and axially spaced apart relative to each other.

4. The device as claimed in claim 3 wherein the first locking member includes a first detent ball disposed within the first radial bore.

5. The device as claimed in claim 4 wherein the second locking member includes a second detent ball disposed within the second radial bore, the first detent ball having a diameter less than the second detent ball.

6. The device as claimed in claim 5 wherein the engagement shaft includes an end having a chamfered edge adapted to abut the first detent ball prior to abutment with the second detent ball when the engagement shaft is inserted into the cavity.

7. The device as claimed in claim 2 wherein the coupler body includes first and second exterior surfaces having respective first and second outer diameters, the first and second exterior surfaces being integrally connected with a substantially frustoconical shoulder portion.

8. The device as claim in claim 7 wherein the first outer diameter is greater than the second outer diameter.

9. The device as claimed in claim 8 wherein the locking structure includes a coupler sleeve disposed around the coupler body and being longitudinally movable relative thereto and having an internally disposed sleeve ramp inclined at an angle approximating that of the frustoconical shoulder portion and inwardly terminating at a base portion thereby defining an annular backstop between the base portion and the coupler sleeve being substantially perpendicular to the longitudinal axis of the coupler body.

10. The device as claimed in claim 9 further comprising an annular sleeve guide circumferentially disposed around the coupler body adjacent to the handle and adapted to slideably support the coupler sleeve.

11. The device as claimed in claim 10 wherein the bias structure includes a compression spring circumferentially disposed around the coupler body between the sleeve guide and the backstop.

12. The device as claimed in claim 1 wherein the cavity includes a key disposed on the inner wall adjacent to the cavity aperture.

13. The device as claimed in claim 12 wherein the attachment shaft includes a keyway for cooperative engagement with the key to axially guide the attachment shaft into the cavity.

14. The device as claimed in claim 1 wherein the locking engagement portion includes a circumferential channel disposed on the engagement shaft.

15. The device as claimed in claim 14 wherein the circumferential channel has a substantially arcuate cross-sectional shape.

16. The device as claimed in claim 1 wherein the coupler body includes a circumferential channel disposed on the inner wall adjacent to the cavity aperture.

17. The device as claimed in claim 16 wherein the circumferential channel includes an annular seal disposed therein and adapted to be in substantial seal-like engagement with the engagement shaft when the engagement shaft is inserted substantially into the cavity.

18. The device as claimed in claim 1 wherein the cavity includes a compression spring disposed adjacent to the terminal wall and adapted to compress when the engagement shaft is inserted substantially into the cavity.

* * * * *